US009960003B2

(12) United States Patent
Geisler et al.

(10) Patent No.: US 9,960,003 B2
(45) Date of Patent: May 1, 2018

(54) APPARATUS FOR GENERATING X-RAY RADIATION IN AN EXTERNAL MAGNETIC FIELD

(71) Applicant: SIEMENS AKTIENGESELLSCHAFT, München (DE)

(72) Inventors: Andreas Geisler, Forchheim (DE); Svetlana Goβmann, Neunkirchen am Brand (DE); Oliver Heid, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 0 days. days.

(21) Appl. No.: 15/544,854

(22) PCT Filed: Jan. 18, 2016

(86) PCT No.: PCT/EP2016/050862
§ 371 (c)(1),
(2) Date: Jul. 19, 2017

(87) PCT Pub. No.: WO2016/120104
PCT Pub. Date: Aug. 4, 2016

(65) Prior Publication Data

US 2018/0019088 A1 Jan. 18, 2018

(30) Foreign Application Priority Data

Jan. 27, 2015 (DE) ..... 10 2015 201 375

(51) Int. Cl.
*H01J 1/304* (2006.01)
*H01J 35/06* (2006.01)
(Continued)

(52) U.S. Cl.
CPC ..... *H01J 1/304* (2013.01); *H01J 3/021* (2013.01); *H01J 9/025* (2013.01); *H01J 31/08* (2013.01);
(Continued)

(58) Field of Classification Search
CPC .. H01J 1/304; H01J 3/021; H01J 31/08; H01J 35/14; H01J 35/10; H01J 35/065;
(Continued)

(56) References Cited

U.S. PATENT DOCUMENTS 6,259,765 B1 7/2001 Baptist
6,819,034 B1 11/2004 Pavlovsky
(Continued)

FOREIGN PATENT DOCUMENTS

DE 102004052478 A1 6/2005
DE 102013214096 A1 4/2014
(Continued)

OTHER PUBLICATIONS

German Search Report for related German Application No. 10 2015 201 375.8 dated Dec. 18, 2015, with English Translation.
(Continued)

*Primary Examiner* — Joseph L Williams
*Assistant Examiner* — Jose M Diaz
(74) *Attorney, Agent, or Firm* — Lempia Summerfield Katz LLC

(57) ABSTRACT

An apparatus is provided for generating X-ray radiation in an outer magnetic field, which may be generated by a magnetic field device. The apparatus includes a cathode configured to generate an electron beam and an anode configured to retard the electrons of the electron beam and generate an X-ray beam. The apparatus further includes a device configured to generate an electric field orientated from the anode in the direction of the cathode and substan-
(Continued)

tially collinear to the outer magnetic field, wherein the cathode, as an electron emitter, includes a cold cathode that passively provides free electrons by field emission.

19 Claims, 1 Drawing Sheet

(51) Int. Cl.

| | |
|---|---|
| ***H01J 35/10*** | (2006.01) |
| ***H01J 9/02*** | (2006.01) |
| ***H01J 35/14*** | (2006.01) |
| ***H01J 31/08*** | (2006.01) |
| ***H01J 3/02*** | (2006.01) |

(52) U.S. Cl.
CPC ..... *H01J 35/065* (2013.01); *H01J 35/10* (2013.01); *H01J 35/14* (2013.01)

(58) Field of Classification Search
CPC .... H01J 9/025; H01J 1/13; H01J 3/024; H01J 19/04; H01J 17/50; H01J 2201/30446; H01J 2201/30; H01J 19/24; H01J 2329/0492
See application file for complete search history.

(56) References Cited

U.S. PATENT DOCUMENTS

| | | | | |
|---|---|---|---|---|
| 6,976,953 | B1 | 12/2005 | Pelc | |
| 7,274,722 | B2 | 9/2007 | Taufenbach | |
| 8,710,843 | B2 | 4/2014 | Carlone et al. | |
| 2003/0123612 | A1* | 7/2003 | Pelc | H01J 35/14 378/137 |
| 2005/0096532 | A1 | 5/2005 | Block et al. | |
| 2007/0046166 | A1 | 3/2007 | Okada et al. | |
| 2009/0039754 | A1 | 2/2009 | Tolt | |
| 2009/0272915 | A1 | 11/2009 | Inaba et al. | |
| 2011/0188634 | A1 | 8/2011 | Lee et al. | |
| 2012/0163530 | A1* | 6/2012 | Sainath | A61B 6/027 378/5 |
| 2015/0003587 | A1* | 1/2015 | Kim | A61B 6/032 378/62 |

FOREIGN PATENT DOCUMENTS

| | | | |
|---|---|---|---|
| EP | 2320446 | A1 | 5/2011 |
| JP | 2001250496 | A | 9/2001 |
| JP | 2005346942 | A | 12/2005 |
| JP | 2008251341 | A | 10/2008 |
| KR | 20100128540 | A | 12/2010 |
| WO | WO2014047518 | A1 | 3/2014 |

OTHER PUBLICATIONS

PCT International Search Report and Written Opinion of the International Searching Authority dated Apr. 28, 2016 for corresponding PCT/EP2016/050862, with English Translation.

* cited by examiner

APPARATUS FOR GENERATING X-RAY RADIATION IN AN EXTERNAL MAGNETIC FIELD

The present patent document is a § 371 nationalization of PCT Application Serial Number PCT/EP2016/050862, filed Jan. 18, 2016, designating the United States, which is hereby incorporated by reference, and this patent document also claims the benefit of DE 10 2015 201 375.8, filed Jan. 27, 2015, which is also hereby incorporated by reference.

TECHNICAL FIELD

The disclosure relates to an apparatus for generating x-ray radiation in an external magnetic field generable by a magnetic field device.

BACKGROUND

An apparatus for generating x-ray radiation includes a cathode for generating an electron beam and an anode for decelerating the electrons of the electron beam and for generating an x-ray beam. Moreover, the apparatus includes a device for generating an electric field that is directed from the cathode in the direction of the anode.

In such an apparatus, the x-ray radiation arises from energetic transitions in the electron shells of atoms or molecules and from the change in velocity of the charged particles per se. In the apparatus, the electrons emitted by the cathode are initially accelerated by the applied electric field and are then incident on the anode, in which they are strongly decelerated. X-ray radiation and heat arise in the process, wherein electrons are ejected from the shells of the atoms as a result of electron and photon interactions. The holes in the shells are filled by other electrons, with, inter alia, the characteristic x-ray radiation arising. Overlaid thereon is the so-called bremsstrahlung, which is caused by the pure change in velocity of the electrons as a consequence of the interaction with the anode.

By way of example, x-ray radiation may be used to shine through the human body, with predominantly bones, but also internal organs, becoming visible. In the field of medical diagnostics, there is a desire to combine x-ray imaging with other imaging methods based on magnetic fields. By way of example, an apparatus for x-ray imaging may be combined with a magnetic resonance imaging (MRI) scanner. Magnetic fields may likewise arise for guiding the catheter in angiography, an imaging medical method which images blood and lymph vessels.

Medical apparatuses for generating x-rays may use hot cathodes. If hot cathodes are exposed to a strong magnetic induction, caused by a magnetic field device such as the MRI or the angiography system, the obtainable electron current is reduced. Likewise, the focusing of the electron beam emitted by the hot cathode is impaired by the optics that are characterized by electric fields. Hence, a substantially smaller electric current density (abbreviated to current density) arises at the anode in comparison with an x-ray apparatus without an external magnetic field. However, a certain, predetermined current density is required for generating the x-ray beam with an intensity that is sufficient for the medical application. It is possible to compensate the reduced current density by increasing the heating temperature of the hot cathode. However, such an increase in the heating temperature impairs the service life of the hot cathode and hence of the x-ray tube.

SUMMARY AND DESCRIPTION

The scope of the present disclosure is defined solely by the appended claims and is not affected to any degree by the statements within this summary. The present embodiments may obviate one or more of the drawbacks or limitations in the related art.

It is an object of the present disclosure to specify an apparatus for generating x-ray radiation operable in an external magnetic field and which may generate a high electric current, without there being a risk of destroying the cathode or a reduction in the service life of the cathode and without the image quality being impaired.

In order to achieve the aforementioned object, an apparatus for generating x-ray radiation in an external magnetic field generable by a magnetic field device is proposed. The apparatus includes a cathode for generating an electron beam, an anode for decelerating the electrons of the electron beam and for generating an x-ray beam, and a device for generating an electric field that is directed from the anode in the direction of the cathode and that is substantially collinear with the external magnetic field. The cathode as an electron emitter includes a cold cathode that passively provides free electrons by field emission.

A substantially collinear electric field refers to an electric field which need not be parallel to the magnetic field at all points. The electrons follow the magnetic field (in the case of a sufficient strength), and so the requirements in respect of the electric field in relation to the alignment thereof are reduced under these conditions. In the conventional case, the electric field needs to be formed in such a way that there is a focusing of the electron beam onto the anode.

Such an arrangement facilitates the generation of a high electron current (e.g., an electron beam with a large number of electrons) by using a cold cathode, without there being a risk of the cathode being ripped apart or destroyed. Because there is no focusing of the electron beam by electric fields under the aforementioned conditions, the emission current reduction, (e.g., in the case of a hot cathode), cannot be compensated by a larger filament without increasing the focal spot. In this conventional case, a beam spot area would increase in correspondence with a projected filament size, as a result of which requirements in respect of the beam spot dimension cannot be observed. By using a cold cathode, a material-specific current density remains largely uninfluenced.

The beam spot dimension describes the region of the electron beam impinging on the anode, which is influenced by the size and form of the cathode and the profile of the two fields. The beam spot may be punctiform, as a result of which the generation of the x-ray radiation will come close to that of the punctiform x-ray source.

In accordance with an expedient configuration, the electron emitter has a linear embodiment. The linear electron emitter may refer to an electron emitter that extends along one direction over its entire length, e.g., a straight and not coiled electron emitter.

Expediently, the electron emitter has a convex surface in the cross section in relation to an axial direction of extent, wherein the convex surface extends exclusively in the direction of the anode and represents the electron emitter. This is accompanied by a reduction in the emitting surface of the electron emitter in comparison with a filament of a hot cathode. This is accompanied by an electron current in the direction of the anode that is uninfluenced by the external magnetic field because it is provided that only electrons in the direction of the anode may emerge from the electron emitter. In particular, a reduction in the emitting surface is also avoided in comparison with a filament of a hot cathode because only the front side of the electron emitter contributes to the electron current.

In the cross section in relation to an axial direction of extent, the electron emitter may have the form of a semi-cylinder. In principle, the convex surface may also be realized by other cross-sectional forms of the electron emitter. The form of a semi-cylinder facilitates a convex surface that exclusively extends in the direction of the anode. In particular, this form renders possible an enhanced field on the area of the semi-cylinder, in particular over the entire linear profile thereof, as result of which the electron emergence is simplified.

It is furthermore expedient if the cathode includes a substrate on which the electron emitter is arranged. The substrate may include a semiconductor material. The substrate may also include a metal. The electron emitter and the substrate are connected to one another in an electrically conductive manner.

In a further expedient configuration, the axial direction of extent extends parallel or at an angle to a first direction, which extends perpendicular to a third direction of the electric field and a second direction transverse to the electric field, wherein an impact area of the anode lies in a plane that extends parallel to the second direction and at an acute angle to the first direction. Depending on the selected dimension of the acute angle, the dimension of the punctiform property of the x-ray beam emerging from the anode may be measured. The punctiform property is satisfied to a greater extent, when a smaller dimension of the acute angle is selected.

In accordance with a further expedient configuration, the cathode includes a substance or substances based on carbon. In particular, the cathode may have an irregular surface in order to simplify the emergence of electrons on account of a field enhancement. The surface may have a film of carbon nanoflakes as field emitting elements. The carbon nanoflakes may have rounded-off or sharp edges.

It is known that the electrons leave the surface of the electron emitter on account of an electric field prevalent there and substantially collinear to the external magnetic field. The electric field may be generated by applying an electric voltage between the cathode and the anode. To this end, a voltage source for providing a first voltage between the cathode and the anode may be provided or interconnected. Alternatively, a further electrode may be arranged between the anode and the cathode, with a voltage source being provided for providing a second voltage between the cathode and the further electrode, the second DC voltage being less than the first DC voltage. A further electrode lying between the anode and the cathode is also known by the name of "puller electrode". The electrons leave the surface of the electron emitter with such a low energy that they follow the field lines of the magnetic field. The voltages may be pulsed in order to switch the beam on and off, for example, with up to 30 frames per second in the case of angiography.

BRIEF DESCRIPTION OF THE DRAWINGS

Below, the disclosure is explained in more detail on the basis of exemplary embodiment in the drawings. In the drawings.

DETAILED DESCRIPTION

Figure 1:
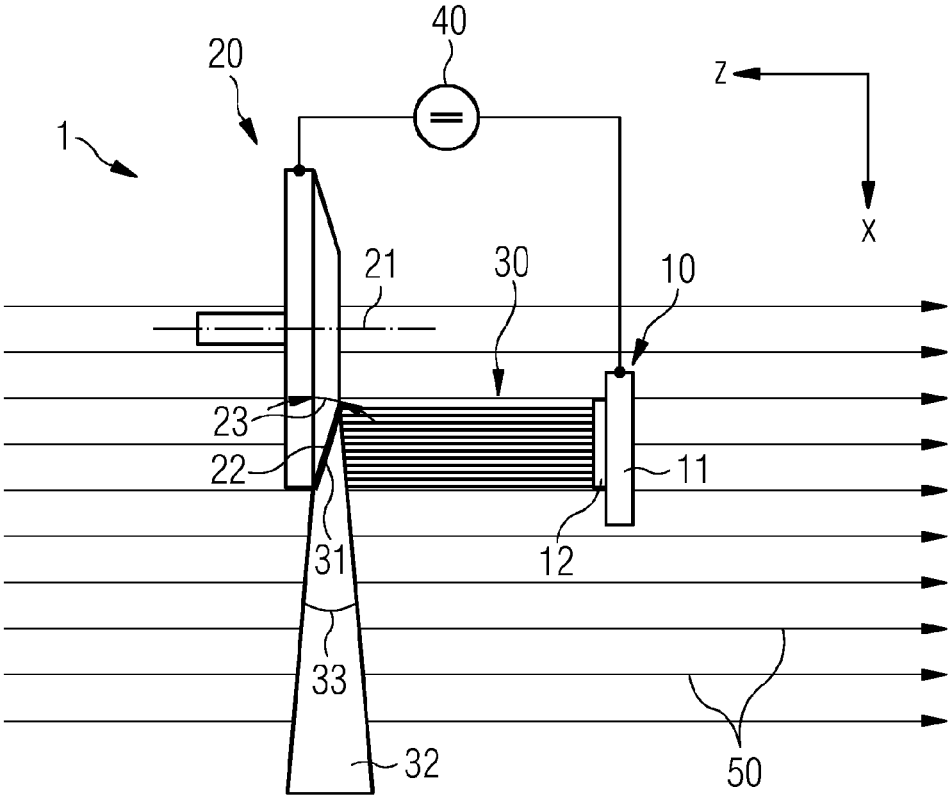
FIG. 1 depicts a schematic illustration of an apparatus according to an embodiment for generating x-ray radiation in an external magnetic field.

FIG. 1 depicts a schematic illustration of an apparatus 1 for generating x-ray radiation 32. The apparatus 1 includes a cathode 10 and an anode 20 that is rotatable about an axis of rotation 21 (a so-called rotating anode). The anode 20 may also be embodied as a stationary anode. By way of a DC voltage source 40, which is interconnected between the cathode 10 and the anode 20, an electric voltage at a given level is applied between said cathode and said anode. As a result, an electric field that is directed from the anode in the direction of the cathode arises. The apparatus 1 is arranged in an external magnetic field 50 that is generated by a magnetic field device not illustrated in any more detail. The magnetic field lines of the magnetic field 50 and the electric field lines of the electric field, which is generated between the anode 20 and the cathode 10, extend largely collinearly. This means that the field lines of the electric field correspond to the field lines of the magnetic field 50.

The arrangement of the apparatus 1 in space is defined in the present description by a coordinate system with a first direction (e.g., x-direction), a second direction (e.g., y-direction) and a third direction (e.g., z-direction). The three directions or axes are at right angles to one another in each case, e.g., the three directions or axes form a Cartesian coordinate system. In accordance therewith, the field lines of the electric field and of the magnetic field run parallel to the x-direction, while the cathode 10 and the anode 20 extend in the xy-plane.

Figure 2:
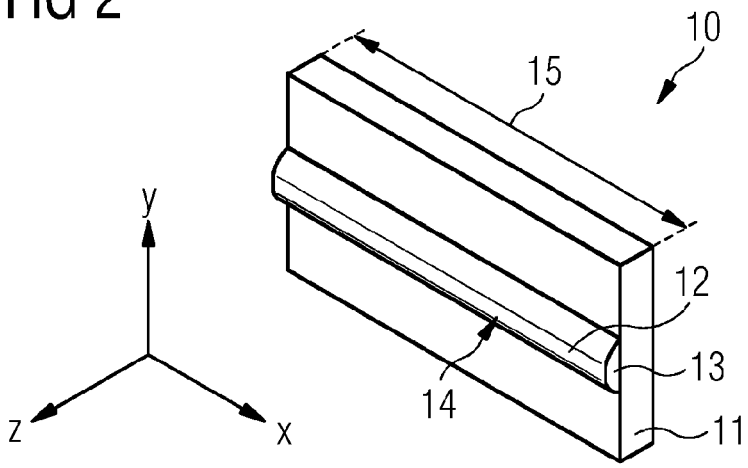
FIG. 2 depicts a perspective illustration of a cathode, as is used in an apparatus in accordance with FIG. 1.

FIG. 2 depicts a magnified illustration of the cathode 10 used in the apparatus 1 in accordance with FIG. 1 in a perspective view. In order to elucidate the arrangement of the cathode 10 in the apparatus 1, FIG. 1 presents a corresponding coordinate system.

The cathode 10 includes a substrate 11 and an electron emitter 12 with a respective length 15. By way of example, the substrate 11 includes a semiconductor material or a metal. The electron emitter 12 has a cross section 13 having a convex surface in relation to an axial direction of extent (e.g., an extent along the x-direction or alternatively at an angle to the x-direction and lying in the xz-plane), with the convex surface extending exclusively in the direction of the anode 20 when the cathode 10 is arranged in the apparatus 1. In the embodiment illustrated in FIG. 2, the electron emitter has the form of a semi-cylinder in cross section. The reference sign 14 characterizes the surface of the electron emitter 12 from which the electrons emerge from the electron emitter on account of the prevalent electric field.

In the exemplary embodiment in accordance with FIG. 2, the electron emitter 12 and the substrate 11 have the same length 15. In principle, this is not required; the length of the substrate 11 may be greater than the length 15 of the electron emitter 12.

The electron emitter 12 includes a substance or substances based on carbon. In particular, the electron emitter 12 may have an irregular surface. Hence, the electron emitter 12 is embodied as a cold cathode. The surface 14 of the electron emitter 12 may include carbon nanoflakes. The carbon nanoflakes may have been applied to the surface 14 of the electron emitter 12 by a chemical vapor deposition (CVD) process. The carbon nanoflakes emerge from a layer made of carbon material initially applied to the substrate 11. An electron emitter with carbon nanoflakes has a better electrical conductivity on account of its graphite structure. Moreover, an increased region for the emission of the electrons is provided. Moreover, the effect of field enhancements may be used on account of the irregular surface, as a result of which the electrons easily emerge from the material of the electron emitter.

As an example of a suitable material for the electron emitter, use may be made of the material described in U.S. Pat. No. 6,819,034 B1 for providing a cold cathode for the use in a computer system.

Referring back to FIG. 1, the cathode 10 described in FIG. 2 is arranged in the apparatus 1 in such a way that the linear electron emitter 12 extends in the direction of the x-direction of the coordinate system. Alternatively, it may also extend at an angle in relation to the x-direction, but lies in the xz-plane. Here, the electron emitter 12 is aligned relative to the anode 20 in such a way that it is arranged in a manner covering the z-direction in relation to an impact region 22 of the anode 20. The impact region 22 of the anode 20 lies in a plane extending in the direction of the y-axis and at an acute angle 23 in relation to the xy-plane of the coordinate system. The dimension of the acute angle 23 sets the size of the apparent surface from which the x-ray beam 32 emerges from the anode 20. The flatter the dimension of the angle 23, the smaller the dimension of the extent of the impact of the electron beam 30 in the z-direction if the impact of the electron beam 30 in the x-direction on the yz-plane is considered.

On account of the linear form of the electron emitter 12, the impact region 22 of the anode 20 in the xy-plane is likewise only irradiated in linear form, as a result of which it is possible, overall, to provide an x-ray beam 32 extending in the x-direction from the yz-plane, the beam spot 31 of which is comparatively small and comes close to a punctiform property.

The electrons leave the surface 14 of the electron emitter 12 with such a low energy that they follow the field lines of the external magnetic field 50. Here, the apparatus 1 is aligned in such a way that the path from the cathode 10 to the anode 20, and hence the intended beam direction, lies collinearly in relation to the magnetic field direction of the external magnetic field 50. As a result, a transverse movement of the electron—except for a rotation with a very small cyclotron radius about the main propagation direction in the z-direction—is practically eliminated. As a consequence, a beam spot 31 forms on the impact surface 22 of the anode 20, said beam spot corresponding to the projection of the emitting area of the magnetic field 50 and hence likewise being linear in accordance with the form of the electron emitter 12.

As a result, it is possible to present a small projected area corresponding to the requirements of the focal spot size in the case of an apparatus 1 for generating x-ray radiation in an external magnetic field 50. This is promoted by the convex form of the surface 14 of the electron emitter 12, which helps the field emission at a given extraction voltage.

The apparatus 1 renders it possible to generate a high electron current without there being a risk of a labile current-carrying conductor (filament) ripping. The reduction in the emitting area and hence also in the undisturbed electron current as a result of the magnetic field, as occurs in the case of a cathode with a coiled filament, does not occur in the proposed apparatus because, in any case, only the front side, (e.g., the surface 14), contributes to the electron current in the employed cold cathode. Hence, a material-specific current density remains largely uninfluenced.

Because the focusing of the electron beam 30 through the electric field no longer occurs and is no longer required, it is possible to avoid the disadvantages that occur when using a hot cathode in a magnetic field.

As a result, it is therefore possible to provide an apparatus 1 having a long lifetime and in which the required current density for generating the x-ray beam is achievable without impairing the service life of the component. This is rendered possible by using a cold cathode for the purposes of generating a sufficiently high current density.

Although the disclosure has been illustrated and described in detail by the exemplary embodiments, the disclosure is not restricted by the disclosed examples and the person skilled in the art may derive other variations from this without departing from the scope of protection of the disclosure. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

The invention claimed is:

1. An apparatus for generating x-ray radiation in an external magnetic field generable by a magnetic field device, the apparatus comprising:

a cathode configured to generate an electron beam;

an anode configured to decelerate the electrons of the electron beam and generate an x-ray beam; and a device configured to generate an electric field directed from the anode in a direction of the cathode, wherein the electric field is substantially collinear with the external magnetic field;

wherein the cathode comprises an electron emitter having a cold cathode that passively provides free electrons by field emission.

2. The apparatus of claim 1, wherein the electron emitter has a linear embodiment.

3. The apparatus of claim 1, wherein the electron emitter has a convex surface in a cross section in relation to an axial direction of extent, wherein the convex surface extends exclusively in a direction of the anode.

4. The apparatus of claim 1, wherein the electron emitter has a form of a semi-cylinder in a cross section in relation to an axial direction of extent.

5. The apparatus of claim 1, wherein the cathode comprises a substrate on which the electron emitter is arranged.

6. The apparatus of claim 3, wherein the axial direction of extent extends parallel or at an angle to a first direction extending perpendicular to a third direction of the electric field and a second direction transverse to the electric field, wherein an impact area of the anode lies in a plane that extends parallel to the second direction and at an acute angle to the first direction.

7. The apparatus of claim 1, wherein the electron emitter comprises carbon.

8. The apparatus of claim 1, wherein the electron emitter has an irregular surface.

9. The apparatus of claim 1, further comprising:

a voltage source configured to provide a voltage between the cathode and the anode.

10. The apparatus of claim 1, further comprising:

a further electrode arranged between the anode and the cathode; and a voltage source configured to provide a voltage between the cathode and the further electrode.

11. The apparatus of claim 2, wherein the electron emitter has a convex surface in a cross section in relation to an axial direction of extent, wherein the convex surface extends exclusively in a direction of the anode.

12. The apparatus of claim 11, wherein the cathode comprises a substrate on which the electron emitter is arranged.

13. The apparatus of claim 12, wherein the axial direction of extent extends parallel or at an angle to a first direction extending perpendicular to a third direction of the electric field and a second direction transverse to the electric field, wherein an impact area of the anode lies in a plane that extends parallel to the second direction and at an acute angle to the first direction.

14. The apparatus of claim 11, wherein the axial direction of extent extends parallel or at an angle to a first direction extending perpendicular to a third direction of the electric field and a second direction transverse to the electric field, wherein an impact area of the anode lies in a plane that extends parallel to the second direction and at an acute angle to the first direction.

15. The apparatus of claim 2, wherein the electron emitter has a form of a semi-cylinder in a cross section in relation to an axial direction of extent.

16. The apparatus of claim 15, wherein the cathode comprises a substrate on which the electron emitter is arranged.

17. The apparatus of claim 16, wherein the axial direction of extent extends parallel or at an angle to a first direction extending perpendicular to a third direction of the electric field and a second direction transverse to the electric field, wherein an impact area of the anode lies in a plane that extends parallel to the second direction and at an acute angle to the first direction.

18. The apparatus of claim 4, wherein the axial direction of extent extends parallel or at an angle to a first direction extending perpendicular to a third direction of the electric field and a second direction transverse to the electric field, wherein an impact area of the anode lies in a plane that extends parallel to the second direction and at an acute angle to the first direction.

19. The apparatus of claim 4, wherein the cathode comprises a substrate on which the electron emitter is arranged.

* * * * *